US005161320A

United States Patent [19]

Shaw

[11] Patent Number: 5,161,320

[45] Date of Patent: Nov. 10, 1992

[54] WEDGE SECURING PICTURE FRAME ASSEMBLY

[76] Inventor: Terry L. Shaw, P.O. Box 195, New Bloomfield, Mo. 65063

[21] Appl. No.: 768,822

[22] Filed: Sep. 30, 1991

[51] Int. Cl.[5] ..... A47G 1/06

[52] U.S. Cl. ..... 40/152.1; 248/469; 40/155

[58] Field of Search ..... 40/158.1, 120, 155, 40/152.1, 152.2, 154, 157; 248/469, 460, 470, 471, 473, 455, 456

[56] References Cited

U.S. PATENT DOCUMENTS

| | | | |
|---|---|---|---|
| 1,341,560 | 5/1920 | Johnson . | |
| 1,361,981 | 12/1920 | Goodnow | 248/455 X |
| 2,388,435 | 11/1945 | Puerner et al. . | |
| 3,883,108 | 5/1975 | Swartz | 248/460 |
| 4,216,936 | 8/1980 | DeSelms . | |
| 4,432,152 | 2/1984 | Daenen . | |
| 4,466,593 | 8/1984 | Odenath . | |
| 4,655,428 | 4/1987 | McCrea . | |
| 4,852,281 | 8/1989 | Bloome et al. . | |

FOREIGN PATENT DOCUMENTS

| | | | |
|---|---|---|---|
| 289628 | 3/1953 | Switzerland | 40/152.1 |

*Primary Examiner*—Kenneth J. Dorner

*Assistant Examiner*—James M. Gardner

*Attorney, Agent, or Firm*—Richard J. Grundstrom

[57] ABSTRACT

A picture frame assembly generally including a picture frame, support leg, key wedge, back and an optional front cover glass. The picture frame can be in any shape but in the preferred embodiment is oval shaped. The supporting leg attaches to the top and bottom of the back side of the picture frame. Typically, the supporting leg is attached by a dovetail connection, but it could be attached by other similar methods. The glass front, picture and back is placed into a rabbet on the frame trough an elongated slot formed between the picture frame and the supporting leg on the back side of the picture frame. A key wedge is then placed or wedged into the elongated slot to hold the front glass, picture and back in the proper position. The self supporting picture frame can then be placed on a shelf or table for viewing. The self supporting picture frame resting on the bottom side of the picture frame and the supporting leg. The picture frame would be at a slight rearward angle when in the resting position to prevent the frame from falling over. The bottom edge of the frame could also include some sort of legs or pads. The support leg could also be constructed to have a variety of different supporting surfaces or legs.

9 Claims, 6 Drawing Sheets

WEDGE SECURING PICTURE FRAME ASSEMBLY

BACKGROUND OF THE INVENTION

The present invention relates to a picture frame assembly and, more particularly, to a self supporting picture frame assembly having a detachable back and a supporting leg assembly integrated with the frame such that the picture frame assembly is self supporting on a horizontal surface, such as a shelf or the like.

Picture frames by themselves have been known and marketed for generations. Picture frames can be made and obtained in practically any size and style. They can be and are made in almost every conceivable geometric shape. A typical example range includes from small to large, from square to rectangular, and from round to oval. Additionally, picture frames can be made to match virtually any style known. Picture frames are commonly made from various types of woods, plastics and metals which can be carved, cut, molded or formed into a large variety of styles to satisfy the desire and taste of the consumer.

Picture frames are typically hung on a vertical surface such as a wall so that a picture or other ornamental object can be displayed for observation. They are typically hung on a nail or hook on the wall by a wire attached to the back side of the picture frame. However, several other methods of hanging a picture on a wall are also known in the art. There are specially designed hanging apparatuses for attachment to the back side of a picture frame as well as several other methods too numerous to mention.

Picture frames are also known in the art to set upon a horizontal surface such as a shelf, desk, fireplace mantel, dresser, etc. In this position, pictures or other ornamental objects are also displayed in such a manner that the picture or object can be observed. There are several apparatuses known in the art which are designed to hold a picture frame, or other such display means, in a position to be easily observed on a horizontal surface. These include easel type appliances which are incorporated as a part of the picture frame or as a separate device to actually hold and support the picture frame, folding legs which are attached to the back of the picture frame, and other type of legs or supporting means which are attached to the back of the picture frame or to the backing itself.

Supporting legs, in one known type, are formed by cutting the backing material along two sides of a generally triangular shaped leg and folding the supporting leg outward from the third side from the back of the picture frame. The picture frame then leans against the leg folded outward from the back. This provides a simple means of supporting a picture on a horizontal surface but it is not stable nor is it aesthetically pleasing to look at.

In another known art there is a slotted plate attached to the back of the picture frame. A leg support is attached to the slotted plate by extensions which fit into the slots. The picture frame then leans against the supporting leg.

In yet another known method, there is a supporting leg which is attached to the rear of a picture frame by hinges. This allows the supporting leg to pivot out of the way when hung on the wall or placed in storage. This also allows the picture frame to fall over when the leg accidently pivots when the picture is bumped or jarred.

The picture or other ornamental object to be displayed must be placed in the picture frame in order to be displayed. It is common to slide a cover glass, picture and a backing material such as cardboard into a slotted opening along one of the edges of the back side of the picture frame. It is also common to insert a cover glass, picture and backing material into a rabbet cut in the inside edges of back side of a picture frame and securing them in place by nails, tacks or triangular or diamond shaped wedges.

There are several problems or inconveniences which accompany the methods of the past known art. Sliding the cover glass, picture and backing material in a slotted opening often results in the picture being misaligned or crooked besides being cumbersome to install. The procedure must often be repeated several time to obtain the desired position. The nails, tacks, or wedges which are used in some designs are frequently lost and are not very convenient to install.

The legs or supporting assembly for displaying a picture or other object on a horizontal surface are often unstable, awkward, hard to use and unsightly. This can cause the picture to be a nuisance to maintain in the desired position and to maintain a pleasing appearance.

Accordingly, it is an object of the present invention to provide an improved picture frame assembly that is adapted to easily position a cover glass, picture or other object, and backing material in a picture frame and securing them in place with a supporting leg and assembly easily attached to the picture frame which allows the picture frame to securely rest upon a horizontal surface such that the picture or object can be displayed.

Another object of the present invention is to provide an improved picture frame assembly in which the supporting leg can be easily installed and removed yet providing a stable and aesthetically pleasing support.

A further object of the present invention is to provide a picture frame assembly that when not in use the frame can be easily disassembled and stored using a minimum amount of space.

Still another object of the present invention is to provide a picture frame assembly which can be easily manufactured in a variety of different shapes and styles.

Still a further object of the present invention is to provide a picture frame assembly which when displayed is aesthetically pleasing and does not significantly distract from the picture or object being displayed.

Another object of the present invention is to provide a picture frame assembly which allows a picture or other object to be displayed to be easily changed when desired.

SUMMARY OF THE INVENTION

To accomplish the foregoing and other objects of this invention there is provided a picture frame assembly which includes a picture frame, support leg, key wedge, back and an optional front cover glass. The picture frame can be in any shape but in the preferred embodiment is an oval shaped picture frame. The supporting leg attaches to the top and bottom of the back side of the picture frame. Typically, the supporting leg is attached by a sliding dovetail connection, but other means could be used. The front glass cover, picture and back is placed into a rabbet on the backside of the frame through an elongated slot formed between the picture frame and the supporting leg on the back side of the picture frame. A key wedge is then placed or wedged into the elongated slot to hold the front glass cover, picture and back in the proper position.

The self supporting picture frame can then be placed on a shelf or table for viewing. The self supporting picture frame rests upon the bottom side of the picture frame and the supporting surface of the supporting leg. The picture frame would be at a slight rearward angle when in the resting position to prevent the frame from falling over. The bottom edge of the frame could also include some sort of legs or pads. The support leg could also be constructed to have a variety of different supporting surface or legs.

These and other objects and features of the present invention will be better understood and appreciated from the following detailed description of the main embodiment thereof, selected for purposes of illustration and shown in the accompanying drawings.

DETAILED DESCRIPTION

Figure 1:
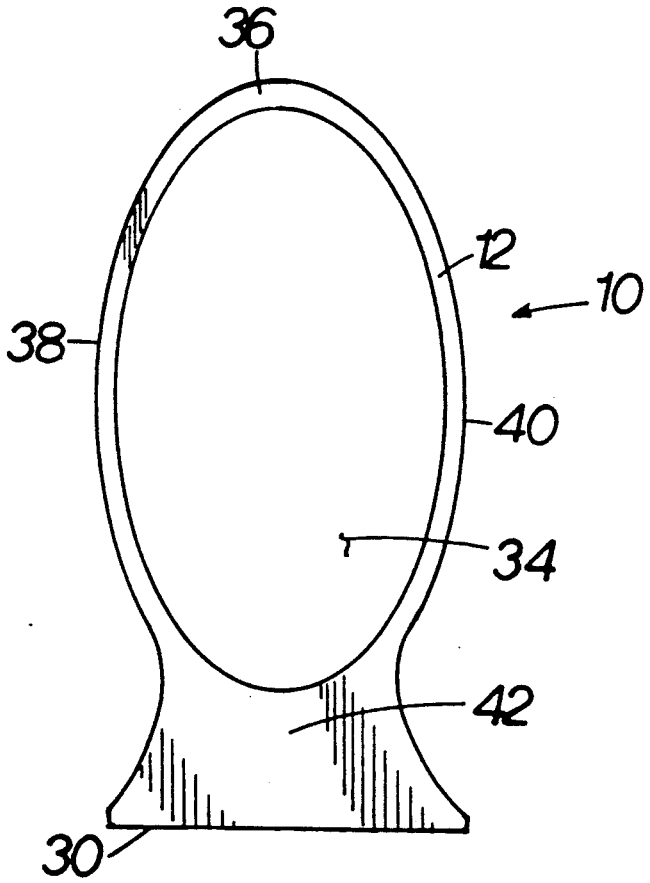
FIG. 1 is a front view of the picture frame assembly.
Figure 2:
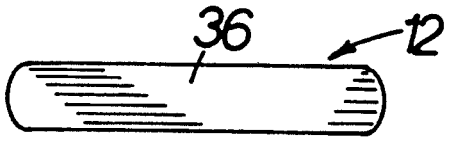
FIG. 2 is a top view of the picture frame assembly.
Figure 3:
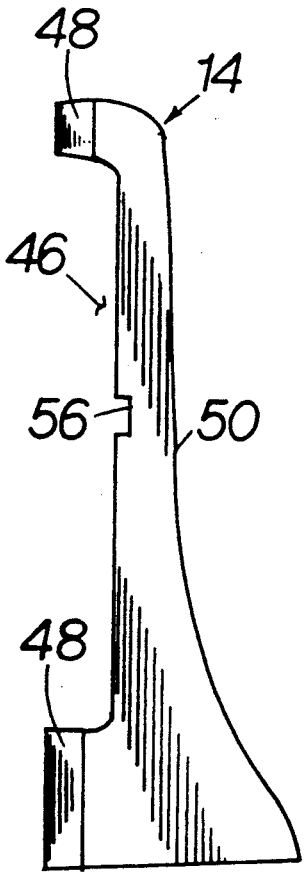
FIG. 3 is a side view of the supporting leg.
Figure 4:
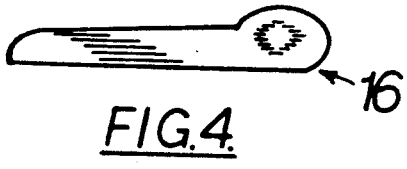
FIG. 4 is a side view of the wedge.
Figure 5:
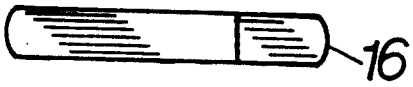
FIG. 5 is a top view of the wedge.
Figure 6:
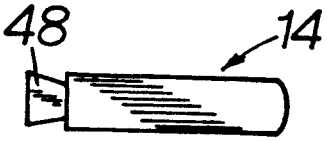
FIG. 6 is a bottom view or the supporting leg, showing the male portion of the sliding dovetail joint.

Referring now to the drawings there is shown one preferred embodiment for the picture frame assembly 10 of this invention. The picture frame assembly 10 generally consisting of a picture frame 12, support leg 14, key wedge 16, back 18 and a front cover glass 20. The picture frame 12 can be in any shape but in the preferred embodiment as illustrated, is an oval shaped picture frame. The supporting leg 14 attaches to the top and bottom of the back side of the picture frame 12. Typically, the supporting leg 14 is attached by a sliding dovetail connection 24, but other means could be used. The front glass cover 20, picture 22 and back 18 is placed into a rabbet 26 on the backside of the picture frame 12 through an elongated slot 28 formed between the picture frame 12 and the supporting leg 14 on the back side of the picture frame 12. A key wedge 16 is then placed or wedged into the elongated slot 28 to hold the front and secure glass cover 20, picture 22 and back 18 in the proper position.

The self supporting picture frame assembly 10 can then be placed on a shelf or table for viewing. The self supporting picture frame assembly 10 rests on the bottom edge 30 of the picture frame and supporting surface 32 of the supporting leg 14. The picture frame assembly 10 would be at a slight rearward angle when in the resting position to prevent the frame from falling over. The bottom edge 30 of the frame could also include some sort of legs or pads. The support leg 14 could also be constructed to have a variety of different supporting surface 32 or legs to contact the horizontal surface as desired or designed.

The preferred embodiment and the best mode contemplated of the picture frame assembly 10 of the present invention are herein described. However, it should be understood that the best mode for carrying out the invention hereinafter described is offered by way of illustration and not by the way of limitation. It is intended that the scope of the invention include all modifications which incorporate its principal design features.

The picture frame 12, generally has an opening 34 through which a picture 22 or other object can be observed, a top 36, bottom 30, sides 38 and 40, front side 42 and back side 44. A rabbet 26 is cut along the inside edge of the opening 34 on the back side 44 of the top 36, bottom 30 and sides 38 and 40 of the picture frame 12. The glass cover 20, picture 22, and back 18 are received in the rabbet 26 for displaying the picture 22. Therefore, the rabbit 26 would have a depth sufficient to receive these components and have a width sufficient to prevent the component from falling through the opening 34.

In the preferred embodiment, the picture frame 12, supporting leg 14, key wedge 16 and back 18 are constructed from wood. However, the picture frame assembly 10 and all the components could also be constructed from plastic, metal or other materials. The material used could be all the same or the materials could be mixed and matched as desired to achieve a desired resulting appearance and structure. The sizes and construction methods as herein described would of course have to be adjusted as appropriate for the materials and construction methods actually used.

The shape of the picture frame 12, in one preferred embodiment and as illustrated, is oval. However, the picture frame could be round, square, rectangular, triangular or in any other regular or irregular shape as desired. The size of the picture frame 12 could also be appropriately sized to accommodate picture sizes from small wallet size pictures or smaller to full size portraits or larger. All other components of the picture frame assembly 10 would be appropriately sized to accommodate the size of the picture frame 12.

The supporting leg 14, as illustrated, is generally an elongated member. The elongated length corresponding to a height slightly less then the height of the picture frame 12. The front side of the supporting leg 14 contains a cut out section 46 which forms the elongated slot 28 when the supporting leg 14 is attached to the picture frame 12. The top and bottom of the front side of the supporting leg 14 contains the male section 48 of the sliding dovetail joint 24. The back of the supporting leg 14 contains a decorative curve 50 extending from the top of the supporting leg 14 to the supporting bottom surface 32. The bottom supporting surface 32 is at a slight angle from the vertical front side of the supporting leg 14 having the male section 48 of the sliding dovetail joint 24. The supporting surface 32 contacts the horizontal surface on which the picture frame assembly 10 is placed and provides the angle at which the picture frame assembly 10 rests.

The female section 52 and 54 of the sliding dovetail joint 24 are cut into the back side 44 of the picture frame 12 at the top 36 and extending from the opening 34 to the bottom edge 30 of picture frame 12. The top female section 54 is cut from the opening 34 toward the top 36 of the picture frame 12 but not completely through. This provides a stop to prevent the supporting leg 14 from sliding completely through the female sections 52 and 54 and provides an aesthetically pleasing appearance.

The supporting leg 14 can then be attached to the picture frame 12 by sliding the male section 48 of the sliding dovetail joint 24 on the front side of the supporting leg 14 into the female section 52 and 54 of the sliding dovetail joint 24 on the backside 44 of the picture frame 12. The dimensions of the cut out section 46 on the supporting leg 14 corresponds to the finished dimensions of the rabbet 26 cut into the inside edge of the opening 34 on the backside 44 of picture frame 12. The cutout section 46 and the back side of picture frame 12 forms the elongated slot 28.

The sliding dovetail joint 24 is the preferred method of attaching the supporting leg 14 to the picture frame 12 but any other method accomplishing the identical or similar result could be used without departing from the scope and spirit of the inventive concepts herein described.

Figure 7:
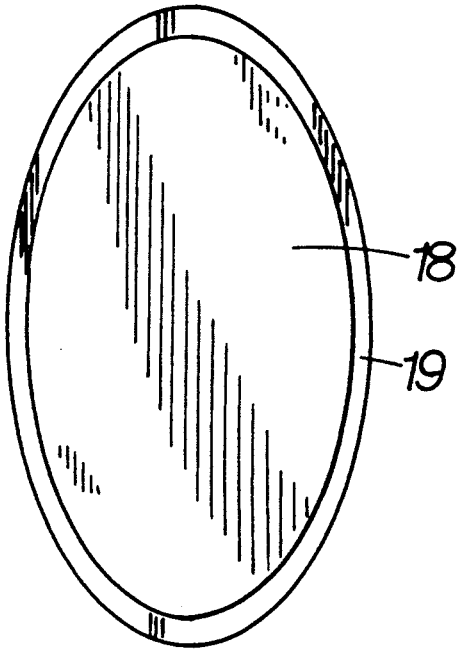
FIG. 7 is a view of the back.
Figure 8:
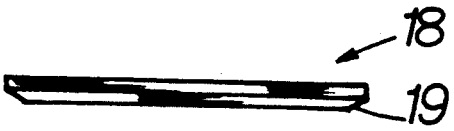
FIG. 8 is an end view of the back.
Figure 9:
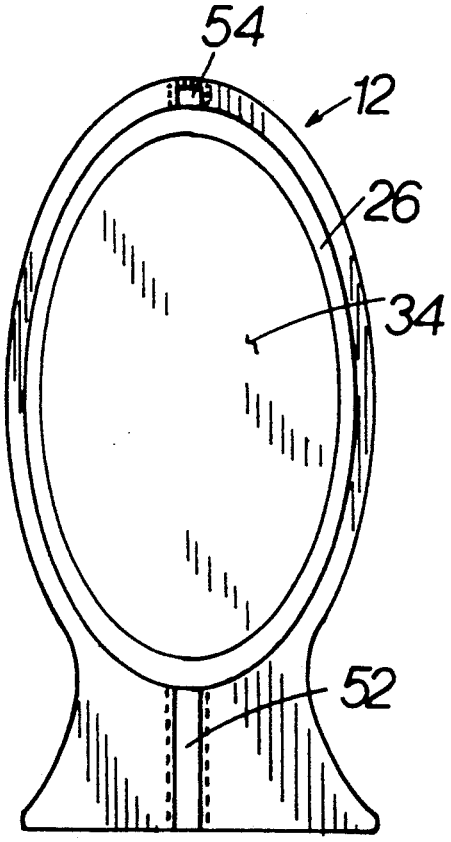
FIG. 9 is a back view of the picture frame.
Figure 10:
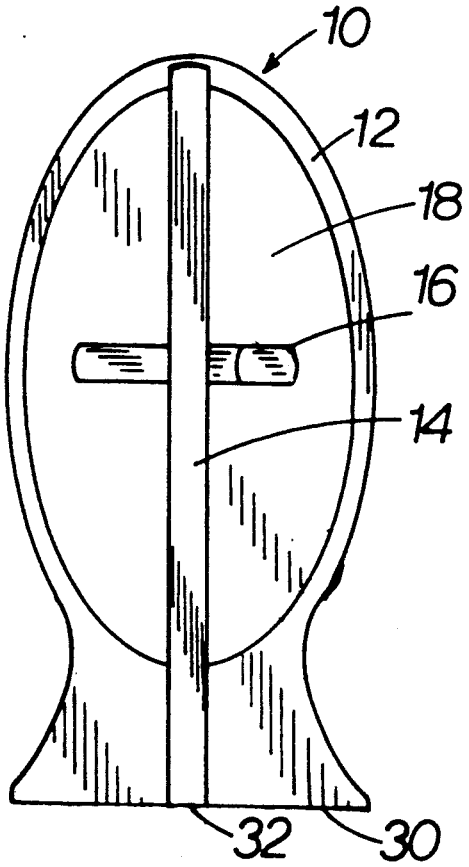
FIG. 10 is a back view of the picture frame assembly.
Figure 11:
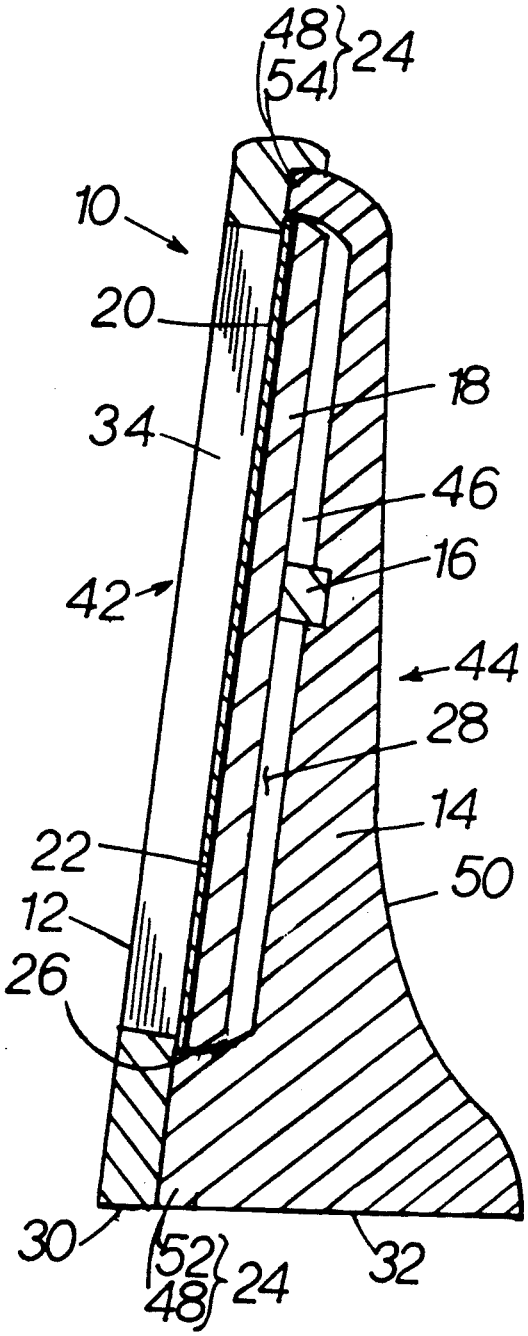
FIG. 11 is a side view of the picture frame assembly.
Figure 12:
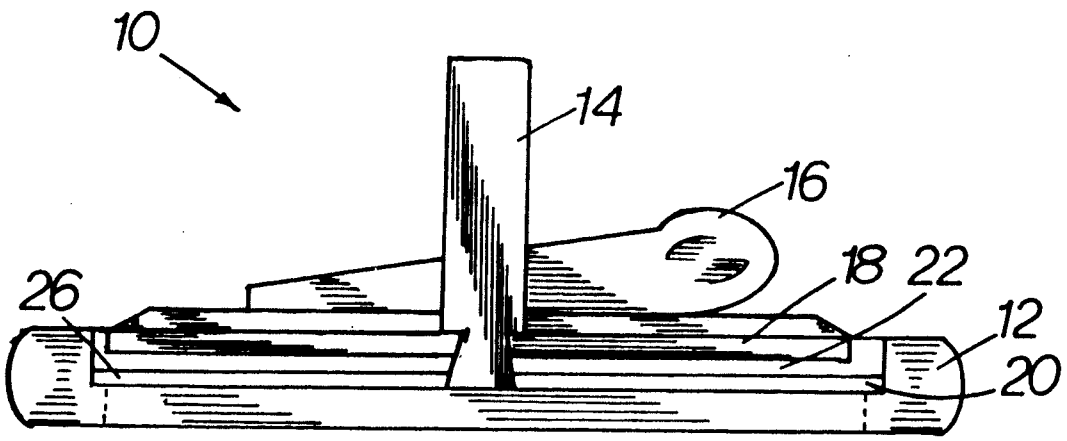
FIG. 12 is a cross sectional view of the picture frame assembly.

The back 18 is generally constructed of a sturdy material which will maintain its shape and will not significantly bend when the wedge 16 is wedged into the elongated slot 28. Generally, the back 18 is constructed from the same material as picture frame 12 but it could be of a different material. The outer edges of the back 18 may contain a decorative finish, such as a chamfered edge 19 as shown in FIGS. 7 and 8. The outer dimensions and shape of the back 18 corresponds to the inside dimensions of the rabbet 26 in the backside 44 of picture frame 12. The thickness of the back 18 can vary but is generally determined by the depth of the rabbet 26 and taking into consideration the thickness of the glass cover 20. The back surface of back 18, when the back 18, picture 22 and glass cover 20 are inserted into the rabbet 26, generally corresponds, more or less, to the back surface of the back side 44 of picture frame 12. Therefore, the thickness of the glass cover 20, picture 22 and back 18 taken together generally corresponds to the debt of the rabbet 26.

In another embodiment, not shown, the back 18 may be split into multiple pieces. The back 18 in a large picture frame 12 may be split either horizontally or vertically along a center line across or down the back 18. The split back 18 allows for an easier installation of the picture 22 and assembly of the components of the picture frame assembly 10.

The picture frame assembly 10 can be used with or without a glass cover 20. If used, the glass cover 20 has the same outer dimensions and shape as the back 18. The width of the glass cover 20 is sufficient to maintain its strength when in the picture frame 12 and taking into consideration the depth of the rabbet 26 and the material which the picture frame 12 is constructed. The glass cover 20 provides protection for the picture 22 or other objects to be displayed. A glass cover is included in the preferred embodiment.

A key wedge 16 is wedged into the elongated slot 28 to secure the glass cover 20, the picture 22 or other object, and the back 18 in the rabbet 26 on the back side 44 of the frame 12 such that the picture 22 or object can be observe through the opeining 34. The key wedge 16 is generally an inclined plane having dimensions corresponding to the width of the elongated slot 28. The key wedge 16 must have the dimensions that the key wedge 16 can be placed into the elongated slot 28 and then be forced or wedged into a position to securely hold the back 18, picture 22 and glass cover 20 in the rabbet 26. The wedge 16 may also be used to secure the supporting leg 14 in position if the sliding dovetail joint 24 is bot tight. This will allow the sliding dovetail joint 24 to be constructed so as to allow the supporting leg 14 to be easily installed onto the picture frame 12 and yet provide for securely holding the picture frame assembly 10 together when in use.

A notch 56 may be provided on the supporting leg 14 within the cut out section 46 for receiving and positioning the key wedge 16. The notch 56 would provide for a consistent positioning of the key wedge 16 and also ensure the positioning would properly secure the key wedge in the correct position to hold the back 18, picture 22 and glass cover 20 in the rabbet 26. The notch would have a width slightly larger then the width of the key wedge 16 and a depth just deep enough to receive the key wedge 16 for positioning.

In another embodiment, not shown, there may be multiple wedges 16 used to secure the glass cover 20, picture 22 and back 18. Multiple wedges 16 would typically be used in larger picture frames which may require additional securing means and possibly where the back 18 is split into multiple pieces. This embodiment may also include additional notches 56 for receiving the additional wedges 16. Typically, the notches 56 and wedges 16 would be equally spaced from each other and from the inside edges of the opening 34 of the picture frame 12, so as to obtain the best supporting position and for an aesthetically pleasing appearance.

In operation, the supporting leg 14 is attached to the picture frame 12 by the sliding dovetail joint 24. The glass cover 20, picture 22, and back 18 are put through the elongated slot 28 and placed into the rabbet 26. The key wedge 16 is wedged into the elongated slot 28 securing the glass cover 20, picture 22 and back 18 in position. The entire picture frame assembly 10 with the picture 22 or other object can then be placed on a horizontal surface for display. The picture frame assembly being at a slight angle from vertical and resting upon the supporting surface 32 of the supporting leg 14 and the bottom edge 30 of picture frame 12.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. A self supporting picture frame assembly for use on a horizontal surface for displaying a picture or other object to be displayed which comprises:

a picture frame having an opening through which a picture or other object can be observed, said picture frame having a top, bottom, sides, front side and back side;

a supporting leg attached to said top and bottom of said back side of said picture frame by an attachment means, said supporting leg and said picture frame forming an elongated slot between said supporting leg and said back side of said picture frame, said elongated slot corresponding to a top and a bottom of said opening through which a picture or other object can be observed;

a back received by said back side of said picture frame within said elongated slot and corresponding to the shape of said opening through which a picture or other object can be observed; and a key wedge wedged into said elongated slot to secure said back and said picture or other object onto said back side of said frame such that said picture or object can be observe through said opening.

2. The picture frame assembly as set forth in claim 1 in which the attachment means comprises a sliding dovetail joint.

3. The picture frame assembly as set forth in claim 1 wherein the picture frame is oval shaped.

4. The picture frame assembly as set forth in claim 1 in which the picture frame assembly further comprises a rabbet along an inside edge of said opening on said back side of said top, bottom and sides of said picture frame.

5. The picture frame assembly as set forth in claim 1 in which the picture frame assembly further comprises a glass cover received on said back side of said picture frame between said picture frame and said back corresponding to said opening to cover a picture or other object to be displayed.

6. The picture frame assembly as set forth in claim 1 in which said supporting leg further comprises a notch for receiving and positioning said key wedge.

7. The picture frame assembly as set forth in claim 1 in which said wedge further secures said supporting leg to said picture frame.

8. A self supporting picture frame assembly for use on a horizontal surface for displaying a picture or other object to be displayed which comprises:

a picture frame having an opening through which a picture or other object can be observed, said picture frame having a top, bottom, sides, front side and back side and a rabbet along an inside edge of said opening on said back side of said top, bottom and sides of said picture frame;

a supporting leg attached to said top and bottom of said back side of said picture frame be an attachment means, said attachment means comprising a dovetail joint, said supporting leg and said picture frame forming an elongated slot between said supporting leg and said back side of said picture frame, said elongated slot corresponding to a top and a bottom of said opening through which a picture or other object can be observed;

a back received by said rabbet in said back side of said picture frame within said elongated slot and corresponding to the shape of said opening through which a picture or other object can be observed;

a glass cover received within said rabbet on said back side of said picture frame between said picture frame and said back corresponding to said opening to cover a picture or other object to be displayed; and a key wedge wedged into said elongated slot to secure said glass cover, said picture or other object, and said back in said rabbet on said back side of said frame such that said picture or object can be observe through said opening.

9. A method of providing a self supporting picture frame assembly for use on a horizontal surface for displaying a picture or other object to be displayed which comprises:

providing a picture frame having an opening through which a picture or other object can be observed, said picture frame having a top, bottom, sides, front side and back side;

attaching a supporting leg to said top and bottom of said back side of said picture frame be an attachment means; said supporting leg and said picture frame;

forming an elongated slot between said supporting leg and said back side of said picture frame, said elongated slot corresponding to a top and a bottom of said opening through which a picture or other object can be observed;

placing a back on said back side of said picture frame within said elongated slot and said back corresponding to the shape of said opening through which a picture or other object can be observed; and wedging a key wedge into said elongated slot to secure said back and said picture or other object onto said back side of said frame such that said picture or object can be observed through said opening.

* * * * *